US006632493B1

(12) United States Patent
Hildebrand, IV et al.

(10) Patent No.: US 6,632,493 B1
(45) Date of Patent: Oct. 14, 2003

(54) MULTI-LAYERED PLASTIC CONTAINER PROVIDING GOOD PRODUCT DRAINAGE

(75) Inventors: Richard Emil Hildebrand, IV, West Chester, OH (US); Robert Joseph Kissner, Cincinnati, OH (US); Pauline Cruz Zamora, Livermore, CA (US); Tomokazu Hattori, Kobe (JP); Hiroshi Furumichi, Hyogo (JP)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 09/402,170

(22) PCT Filed: Mar. 24, 1998

(86) PCT No.: PCT/IB98/00442

§ 371 (c)(1),
(2), (4) Date: Aug. 3, 2001

(87) PCT Pub. No.: WO98/43881

PCT Pub. Date: Oct. 8, 1998

Related U.S. Application Data

(63) Continuation of application No. 08/829,277, filed on Mar. 31, 1997, and a continuation of application No. PCT/US97/05138, filed on Mar. 31, 1997, now abandoned.

(51) Int. Cl.[7] ..... B29D 22/00

(52) U.S. Cl. ..... 428/35.7; 428/483; 426/394; 426/397; 426/398; 222/206; 222/214; 222/215

(58) Field of Search ..... 428/35.7, 483; 426/394, 397, 398; 206/823, 828, 438; 222/206, 214, 215

(56) References Cited

U.S. PATENT DOCUMENTS

| | | | | |
|---|---|---|---|---|
| 3,221,954 A | * | 12/1965 | Lux | 215/10 |
| 3,282,729 A | | 11/1966 | Richardson et al. | |
| 3,598,269 A | | 8/1971 | Carmen | |
| 4,079,850 A | | 3/1978 | Suzuki et al. | |
| 4,082,854 A | | 4/1978 | Yamada et al. | |
| 4,217,161 A | | 8/1980 | Yamada et al. | |
| 4,311,250 A | | 1/1982 | Ravve et al. | |
| 4,327,052 A | * | 4/1982 | Sauer | 264/512 |
| 4,413,974 A | * | 11/1983 | Kontz | 425/523 |
| 4,482,586 A | | 11/1984 | Smith et al. | |

(List continued on next page.)

FOREIGN PATENT DOCUMENTS

| | | |
|---|---|---|
| DE | 44 15 549 A | 11/1995 |
| DE | 195 05 700 A | 8/1996 |

(List continued on next page.)

OTHER PUBLICATIONS

Plastics Design Library, Permeability and Other Film Properties of Plastics and Elastomers, Film Properties, thermoplastic, polyester, PET.*

*Primary Examiner*—Harold Pyon
*Assistant Examiner*—Chris Bruenjes
(74) *Attorney, Agent, or Firm*—Leonard W. Lewis

(57) ABSTRACT

Disclosed is a multi-layered plastic container (10) that substantially enhances product drainage and reduces product residual levels trapped in the container, especially for viscous liquid products, including oil-in-water emulsions, water-in-oil emulsions, polymeric gels, foams, surfactant mixtures, dispersions, colloidal dispersions, suspensions, polymer solutions, polymer melts, and products like catsup, mustard, syrup, etc. In a particularly preferred embodiment, the plastic container is made by blow-molding an extruded parison having an outer polyolefin layer (14), an intermediate adhesive layer (18), and an inner product-contacting layer (16) of a polyester material such as glycol-modified polyethylene terephthalate. In another particularly preferred embodiment, the plastic container is extrusion blow-molded from a four-layer parison comprised of an outer polyolefin layer, an intermediate adhesive layer, an inner polyester layer, and a scrap or regrind layer comprised of a blend of these three layers recovered from the flash removed from the finished container.

11 Claims, 1 Drawing Sheet

U.S. PATENT DOCUMENTS

| | | | | | |
|---|---|---|---|---|---|
| 4,525,134 | A | | 6/1985 | McHenry et al. | |
| 4,534,930 | A | | 8/1985 | Nohara | |
| 4,698,246 | A | * | 10/1987 | Gibbons et al. | 426/127 |
| 4,743,479 | A | | 5/1988 | Nakamura et al. | |
| 4,753,832 | A | * | 6/1988 | Brown et al. | 229/176 |
| 4,818,575 | A | | 4/1989 | Hirata et al. | |
| 4,832,211 | A | | 5/1989 | Matthews et al. | |
| 4,846,359 | A | * | 7/1989 | Baird et al. | 215/12.2 |
| 4,919,984 | A | | 4/1990 | Maruhashi et al. | |
| 4,923,723 | A | | 5/1990 | Collette et al. | |
| 5,049,345 | A | | 9/1991 | Collette et al. | |
| 5,115,012 | A | * | 5/1992 | Howe | 524/456 |
| 5,122,399 | A | | 6/1992 | Farrell et al. | |
| 5,153,038 | A | | 10/1992 | Koyama et al. | |
| 5,188,787 | A | | 2/1993 | King et al. | |
| 5,238,718 | A | | 8/1993 | Yano et al. | |
| 5,320,889 | A | | 6/1994 | Bettle, III | |
| 5,330,808 | A | | 7/1994 | Duff et al. | |
| 5,332,121 | A | * | 7/1994 | Schmidt et al. | 222/105 |
| 5,342,662 | A | | 8/1994 | Aoyama et al. | |
| 5,435,452 | A | | 7/1995 | Nishigami et al. | |
| 5,443,868 | A | | 8/1995 | Oda et al. | |
| 5,567,377 | A | | 10/1996 | Nishigami et al. | |
| 5,667,073 | A | | 9/1997 | Okui | |
| 5,733,617 | A | * | 3/1998 | Baduel | 428/141 |

FOREIGN PATENT DOCUMENTS

| | | |
|---|---|---|
| GB | 1 414 382 A | 11/1975 |
| JP | 60009959 | 1/1985 |
| JP | 61027252 | 2/1986 |
| JP | 01127307 | 5/1989 |
| JP | 02008047 | 1/1990 |
| JP | 02145337 | 6/1990 |
| JP | 03038339 | 2/1991 |
| JP | 03133638 | 6/1991 |
| JP | 03138145 | 6/1991 |
| JP | 04094933 | 3/1992 |
| JP | HEI-04-25317 | 6/1992 |
| JP | 05162737 | 6/1993 |
| JP | 05338639 | 12/1993 |

* cited by examiner

MULTI-LAYERED PLASTIC CONTAINER PROVIDING GOOD PRODUCT DRAINAGE

CROSS-REFERENCES TO RELATED APPLICATIONS

This application is a 371 of PCT/IB98/000442, filed Mar. 24, 1998, which is a continuation of U.S. application Ser. No. 08/829,277, filed Mar. 31, 1997, now abandoned, and a continuation of PCT/US97/05138, filed Mar. 31, 1997.

TECHNICAL FIELD

The present invention relates to multi-layered plastic containers and methods of making such containers. More particularly, the present invention relates to a multi-layered plastic container having inside surface properties that results in enhanced product drainage from the container and the reduction of product residual levels.

BACKGROUND OF THE INVENTION

Typically, viscous liquid or semi-liquid products are packaged in jars, bottles, tubes, or other containers, and frequently these containers provide a pour-spout or other form of egress for pouring, pumping, or squeezing the product out of the container. Polyethylene (PE) resins have been widely used as favorable material for making packages, for example squeeze bottles, which contain viscous fluids due to their good thermoplasticity, good moldability, and good squeezability. They are also economic, which is an important factor for packaging material, as consumers are usually not willing to pay a significant upcharge for packaging which will eventually be discarded. Certain viscous products have a tendency to stick to or hang-up on the inside surface of these containers, so that a certain portion of the product stays in the container as residue which is thrown out with the container. This results in wasted product and decreases the value the consumer receives from purchasing the product. Therefore, there exists a need to provide a product-contacting inner surface on containers and a particular bottle shape that prompts the product to drain more readily from the container to decrease the residual level.

High product residual levels have been a problem with polyethylene containers, especially when the products contained in the containers are viscous, e.g., oil-in-water emulsions, water-in-oil emulsions, polymeric gels, foams, surfactant mixtures, dispersions, colloidal dispersions, suspensions, polymer solutions, polymer melts, products like catsup, mustard, syrup, etc. Typically, such viscous products are attracted to the interior surface of polyethylene containers. This attraction leads to a residual layer of product remaining on the interior container walls. As a result, a large percentage of the product (from 5% to 25%, or more depending on the ambient temperature and product rheology) cannot be evacuated from the container, and ends up as waste, particularly at cooler ambient temperatures when the products become very thick, almost to the point of non-flowing. Therefore, an object of the present invention is to reduce product residual levels to a level less than about 5% by weight of product initially in the container, which is a reduction of at least 35% by weight as compared to a PE container of similar shape, thereby minimizing the amount of wasted product.

SUMMARY OF THE INVENTION

The present invention provides a multi-layered plastic container for containing a viscous product of at least 10,000 cps which provides enhanced product drainage from the container. The container comprises an outer polymer layer providing relative flexibility and structural support, connected to an inner polymer layer having an inner surface that contacts the product and provides for enhanced product drainage from the inner surface. The viscous products suitable for use in accordance with the present invention include water-in-oil emulsions, oil-in-water emulsions, polymeric gels, foams, surfactant mixtures, dispersions, colloidal dispersions, suspensions, polymer solutions, polymer melts, and products like catsup, mustard, syrup, etc.

The inner layer may be formed from polyester, ethylene vinyl acetate, polymethylmethacrylate, a thermoplastic cellulosic, a polycarbonate, polyvinylchloride, polyvinylidene chloride, or Surlyn. The polyester may be either polyethylene terephthalate or glycol-modified polyethylene terephthalate. The ethylene vinyl acetate preferably has a vinyl acetate content of at least about 7.5%, more preferably at least about 12%, and most preferably at least about 18%. The grade of Surlyn, which is an ionomer manufactured by DuPont, may be selected from, but not limited to, 1650, 1652, and 9120. The thermoplastic cellulosic may be cellulose acetate, cellulose acetate propionate, or cellulose acetate butyrate. The plastic container may also include an adhesive layer and a regrind layer.

To further enhance product drainage from the container, the inner layer should have a surface roughness of no more than 0.5 $\mu$m.

The present invention is still further directed to a method of draining a viscous content from a package comprising the steps of (a) providing a package as described above; and (b) draining the viscous content as described above.

These and other features, aspects, and advantages of the present invention will become evident to those skilled in the art from a reading of the present disclosure.

BRIEF DESCRIPTION OF THE DRAWINGS

While the specification concludes with claims particularly pointing out and distinctly claiming the subject matter regarded as forming the present invention, it is believed that the invention will be better understood from the following description with reference to the drawings, in which like reference numerals identify like elements, and wherein:

DETAILED DESCRIPTION OF THE INVENTION

Figure 1A:
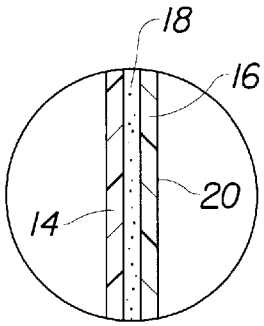
FIG. 1A is an enlarged partial view of the multi-layered construction shown in FIG. 1.
Figure 1:
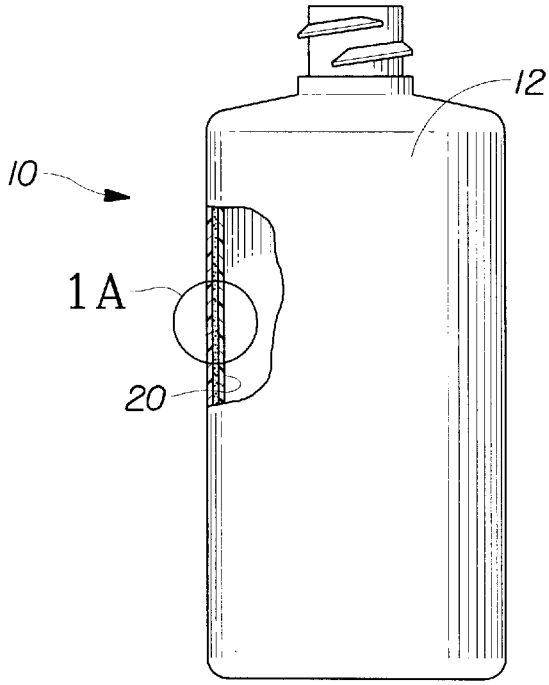
FIG. 1 is a front view of a multi-layered plastic container of the present invention with a portion of the container's sidewall cut away to illustrate its multi-layered construction.

In the following detailed description of the present invention, the terms "container", "package", and "bottle" are used synonymously throughout. FIG. 1 is a front view of a container generally indicated as 10 having a portion of its body section 12 cut away to more clearly illustrate its laminate construction. In this particularly preferred embodiment, and referring to FIG. 1A, container 10 includes an outer layer 14 comprised, for example, of a polyolefin material such as polyethylene or polypropylene, or a mixture thereof, or polyvinylchloride, or polystyrene; these are traditional container materials that provide for strength, flexibility, and aesthetic benefits, all at a relatively low cost. Also included is an innermost product-contacting layer 16 which is selected for its ability to enhance product drainage from the container due to hydrophilic properties, to be described in further detail below. This inner layer 16 is made, for example, of a polyester material such as polyethylene terephthalate or glycol-modified polyethylene terephthalate (hereinafter referred to as "PET or PETG") or of ethylene vinyl acetate with a vinyl acetate content of at least about 7.5%, more preferably at least about 12%, and most preferably at least about 18%. The innermost layer 16 may also be made of Surlyn (grades such as 1650, 1652, 9120), polymethylmethacrylate, a thermoplastic cellulosic n(cellulose acetate, cellulose acetate propionate, or cellulose acetate butyrate), a polycarbonate, or polyvinylchloride, or polyvinylidene chloride. Surlyn is a commercially available ionomer resin from DuPont, typical of those well-known in the art, which may be characterized as a metal-containing ionic copolymer obtained by the reaction between ethylene or an alpha-olefin with an ethylenically unsaturated monocarboxylic acid such as acrylic or methacrylic acid wherein at least 10% of the carboxylic acid groups are neutralized by an alkali metal ion. Such ionomer resins are disclosed in U.S. Pat. No. 3,496,061.

The inner or draining layer 16 can also be made from materials having free hydroxy groups, such as ethylene vinyl alcohol copolymer, polyethylene terephthalate, glycol-modified polyethylene terephthalate, and mixtures thereof. Commercially available materials useful herein for the draining layer include ethylene vinyl alcohol copolymers available with tradenames in the EVAL® series available from Kuraray Co., Ltd.

To improve adhesion between these two layers, as well as to increase the drop strength of finished container 10 by promoting structurally sound pinch-off welds at the container's base, an intermediate adhesive or tie layer 18 may optionally be included. The need for a tie layer is determined by the materials selected for the inner and outer layers of the container. For example, a tie layer is not required when an inner layer of Dupont EVA 3165 is bonded to an HDPE outer layer. However, a tie layer is required to adhere a PETG inner layer to an HDPE outer layer. Tie layer resins are generally polyolefin-based, interlaminar bonding agents that are used to adhere incompatible layers in laminated polymer structures. Choosing a tie resin for a particular application depends on various factors such as the chemical nature of the materials being bonded, their melt viscosities, processing temperatures, and the type of laminating process and equipment being used. Examples of tie resins include the CXA family available from DuPont Chemical. Other examples include the Plexar family available from Northern Petrochemical Company, which include LDPE, MDPE, HDPE, PP, and EVA copolymers. Examples of particularly preferred materials suitable for tie layer 18 between a HDPE outer layer and a PET or PETG inner layer include DuPont CXA 1123, and DuPont CXA 2100 series anhydride-modified ethylene acrylates. An inner scrap or regrind layer may also be included; the regrind layer is comprised of a blend of the three other layers recovered from the flash removed from the finished container. The inner, smoother, product contacting surface 20 possesses hydrophilic properties, which account for the product shedding characteristics of the containers of the present invention.

It is possible to manufacture a container totally from a hydrophilic material like polyester (e.g., polyethylene terephthalate (PET) and glycol-modified polyethylene terephthalate (PETG)) which has excellent product shedding characteristics, but such containers are inherently clear which is undesirable for many products, are more expensive to produce due to material and manufacturing costs, and have less favorable "squeezability" characteristics than HDPE containers. Unfortunately, a container made from most grades of PET cannot be extrusion blow-molded, because an extrusion blow-molding process can only be used when the polymer has sufficient viscosity, cohesion, and tensile strength in its molten state to support its own weight. Molten PET simply does not possess these properties. Extrusion grade PET (EPET) may be blow molded, but it can be more costly and difficult to process due to the necessity of high processing temperatures. Thus the need for the multi-layer construction to deliver the benefits of the present invention along with the strength, flexibility, cost, and aesthetic benefits of a container made mostly of HDPE.

Container 10 is typically made by using an extrusion blow-molding process, for example as described in U.S. Pat. No. 4,846,359 by Baird et al., hereby incorporated by reference herein. In such a process, molten thermoplastic material is extruded through an extrusion die head to form a parison. A mold is closed around the parison such that it pinches the parison's tail to form the container's bottom wall. The parison is then expanded by injecting pressurized air into the parison until it comes into contact with the mold's interior surface. After the formed container has cooled and solidified, the mold is opened and the finished container removed.

Container 10 may also be made by using an injection molding process, for example as described in U.S. Pat. No. 4,923,723 by Collette et al., U.S. Pat. No. 4,743,479 by Nakamura et al., and U.S. Pat. No. 4,525,134 by McHenry et al., all hereby incorporated by reference herein. In such a process, typically a preform is injection molded, cooled, then subsequently reheated and blow-molded into the final container shape and size.

Figure 2:
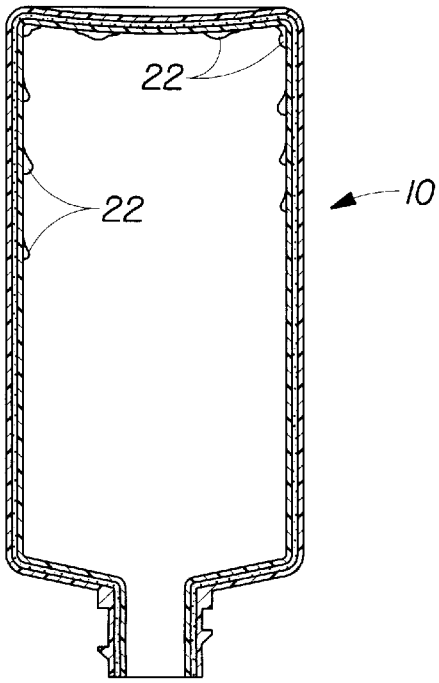
FIG. 2 is an instantaneous cross-sectional view of a container of the present invention, depicting substantially reduced product residuals.

Normally, one skilled in the art would expect that an emulsion, especially one that is more than 50% water, would have an affinity for a hydrophilic material like PET, PETG, or EVA. However, our work has demonstrated surprisingly that the surface chemistry of these draining inner layers is such that the emulsion drains more readily from these materials than it does from HDPE which is hydrophobic. FIG. 2 depicts the minimal residual lees of product 22 remaining in a container of the present invention. Products to be used with the present invention include water-in-oil emulsions, oil-in-water emulsions, polymeric gels, surfactant mixtures, dispersions, colloidal dispersions, suspensions, foams, polymer solutions, polymer melts, and products like catsup, mustard, syrup, etc.

In addition to the surface chemistry of the inner draining layer, the surface roughness of the inner layer also effects product drainage. A viscous liquid, like an emulsion, will drain more quickly from a smooth surface than from a rough surface. Therefore, the container of the present invention comprises a inner layer with a surface roughness of no more than 0.5 $\mu$m, preferably no more than 0.2 $\mu$m. The surface roughness as used herein is measured by a Wyko NT-2000 Optical Profiler. The surface of blow-molded PET, PETG, or EVA tends to be smoother than blow-molded HDPE; this is believed to add to the container's overall enhanced ability to reduce residual levels and increase product drainage from the container. Due to the flow properties and characteristics inherent in PETG, an almost mirror-like finish can be obtained when PETG is blow molded. On a microscale, blow molded HDPE has a much higher surface roughness, and this adds to product hanging up inside containers. For example, the surface roughness of a co-extruded PETG inner lining is 0.3 $\mu$m, while the roughness on the inner surface of a blow molded HDPE container can be greater than 0.8 $\mu$m.

To further aid in the evacuation of the viscous product from the container, the package should provide the consumer squeezability. To enhance performance and squeezeability, the cross-section of the preferred embodiment is either oval or circular. If the cross-section is oval, the aspect ratio should be no more than about 2.5:1, more preferably 1.5:1. If the cross-section is circular, the diameter should be less than about 90 mm, preferably 60 mm. A plastic container, particularly a squeeze bottle, made to these specifications is easier for the consumer to hold and squeeze with one hand. In a preferred embodiment, the multi-layered plastic container is resiliently deformable by external forces during normal use such that it tends to return to its original, undeformed shape following application of squeezing forces by a consumer.

The thickness of the package, as well as the layers which construct the package, also affect the squeezability and cost of the final package. Generally, the average thickness of the wall of the package is less than 1.5 mm, preferably from about 0.5 mm to about 1.5 mm. The average thickness ratio of the outer supporting layer to the inner draining layer is at least about 5 times, preferably from about 20:1 to about 5:1, more preferably about 10:1. When an adhesive layer is provided in-between the supporting layer and the draining layer, the adhesive layer should have a thickness of less than about 1/10, preferably less than about 1/20, as that of the supporting layer to provide good squeezability.

The angle of the shoulder area of the container will also affect the amount of the viscous product that can be evacuated from the package. When the squeeze-to-dispense package is stored inverted, a sloped shoulder allows more product to drain towards the dispensing orifice of the bottle versus a shoulder without a slope. Therefore, the present invention incorporates a shoulder angle of at least 5°, more preferably 10°. This will help the consumer remove more of the contents from the container. To further help the consumer direct the flow of product from the container, the cross-sectional area of the opening in the bottle finish is less than about 50% of the cross-sectional area of the body portion of the container.

While much of the foregoing discussion has focused upon container designs where product drainage toward the fitment is desirable, such as for inverted-bottle dispensing, the principles of the present invention are believed to be equally applicable to other container configurations where low product residual levels are important. For example, containers could be designed for use with pump dispensing devices wherein the lower portion of the container opposite from the fitment facilitates collection of product for evacuation via a diptube, such as a container with a converging and/or conical base opposite from the fitment. Many suitable bottle designs may prove suitable for such an execution, including those with an outer base element to support a generally conical bottle wall design.

The packaged product of the present invention comprises a content in contact with the draining layer, the content having a viscosity of at least about 10,000 cps. The viscosity as used herein is measured by the Rheometric Scientific dynamic stress rheometer model SR-5000 with a parallel plate configuration at 25° C.

The content can be in any form having the above defined viscosity including oil-in-water emulsions, water-in-oil emulsions, polymeric gels, aqueous dispersions and suspensions, colloidal dispersions, foams, liquid crystals, polymer solutions, polymer melts and can be any kind of product including; cosmetic or beauty care products for the hair and skin such as shampoo, conditioner, treatment, gel, lotion, oil, cream; laundry and cleaning products such as dishwashing detergent, liquid hand soap, liquid laundry detergent, stain remover, fabric softener; food products such as salad dressing, catsup, mustard, and syrup; health care products such as tooth paste and liquid medicine; and other industrial products.

Figure 3:
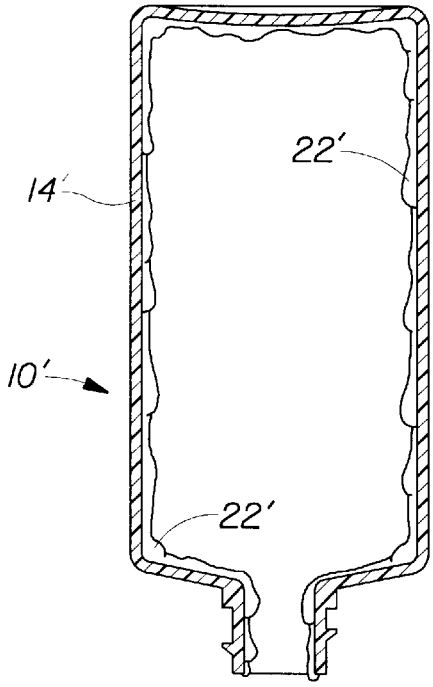
Prior Art Fig. 3
FIG. 3 is an instantaneous cross-sectional view of a prior art container, depicting substantial residual product.

Our testing has resulted in product residual levels of only about 2% for a viscous product contained in a squeeze bottle of the present invention, while normal residual levels associated with a similarly-sized and shaped HDPE squeeze container at normal temperatures average about 7% to 15%. FIG. 3 depicts an instantaneous cross-sectional view of a conventional package 10' made of a single polyethylene layer 14' after drainage of a viscous content, such as a content described above, and shows substantial residual content 22'. FIG. 2 is an instantaneous cross-sectional view of a preferred embodiment of the packaged product of the present invention having the same package form, after drainage, depicting significantly reduced residual levels 22 compared to FIG. 3. Here in, "significantly reduced residuals levels" refers to a reduction in product residuals levels of at least 35% compared to a polyethylene package having the same package shape. A 35% reduction in residuals will normally yield a residuals level of less than about 5% for a typical squeeze bottle. Therefore, the inner polymer layer of the container and the product interact synergistically in accordance with the present invention to provide a product containment and delivery system yielding a product residual level by weight of less than about 5%, more preferably less than about 4%, still more preferably less than about 3%, and most preferably about 2%.

The amount of residual product left in a container was measured using the following test method:

1. Record weight of each assembled package.
2. Fill each sample with a predetermined fill weight and record weight.
3. Allow the package to sit in an "inverted" position for 24 hours at a given temperature (normally ambient temperature).
4. Dispense the package to approximately 1/3 full and allow package to rest inverted for at least one hour.
5. Repeatedly squeeze package until less than five grams of product is dispensed per squeeze.
6. Tap the package five times against hard surface and dispense the product. Repeat the process until package does not dispense a minimal dosage of five grams.
7. Allow package to rest in an inverted position for 24 hours and repeat steps 5 and then 6. The test is finished when less than five grams is dispensed on the first dispensing cycle after a 24 hour waiting period.
8. Record empty weight and calculate the percent residual.

EXAMPLES

The following examples further describe and demonstrate embodiments within the scope of the present invention. The examples are given solely for the purpose of illustration and are not to be construed as limitations of the present invention, since many variations thereof are possible without departing from the spirit and scope of the invention.

Ingredients are identified by chemical or CTFA name, or otherwise defined below.

The ingredients herein are expressed by weight percentage of the total compositions, unless otherwise specified.

Examples I and II

These examples show packaged hair conditioning products of the present invention. Such compositions are described in greater detail in published PCT patent applications WO 97/31616 and WO 97/31617. The package for EXAMPLES I and II are the cylindrical bottles as shown in FIG. 1. The contents are hair conditioning compositions including the following components and made with the method following thereof.

| Component (Wt. %) | Ex.I | Ex.II |
|---|---|---|
| Stearamidopropyldimethylamine*1 | 2.00 | 1.60 |
| L-Glutamic Acid*2 | 0.64 | 0.51 |
| Cetyl Alcohol*3 | 2.50 | 2.00 |
| Stearyl Alcohol*4 | 4.50 | 3.60 |
| Silicones*5 | 4.20 | 3.36 |
| Benzyl Alcohol | 0.40 | 0.40 |
| EDTA | 0.10 | 0.10 |
| Kathon CG*6 | 0.03 | 0.03 |
| Sodium Chloride | — | 0.01 |
| Perfume | 0.20 | 0.20 |
| Water | 85.43 | 88.19 |

Water, stearamidopropyldimethylamine and about 50% of L-glutamic acid are mixed at a temperature above 70° C. Then the fatty alcohols and benzyl alcohol are added with agitation. After cooling down below 60° C., the remaining L-glutamic acid and other remaining components are added with agitation, then cooled down to about 30° C. The cylindrical bottles are filled with the hair conditioning compositions for sale to consumers.

The cylindrical bottles for Examples I and II have an interior surface roughness in the range of from about 0.085 μm to about 0.090 cm. The hair conditioning compositions of Example I and II have a viscosity in the range of from about 11,000 cps to about 29,000 cps, and from about 11,000 cps to about 21,000 cps, respectively.

Examples I and II have many advantages. For example, they can provide good drainage of the hair conditioning composition, good squeezability upon dispensing, and retain the shape of the package quickly after squeezing pressure is released. Definitions 1 Stearamidopropyldimethylamine: AMIDOAMINE MPS obtained by Nikko 2 L-glutamic acid: L-GLUTAMIC ACID (cosmetic grade) obtained by Ajinomoto 3 Cetyl Alcohol: KONOL series obtained by New Japan Chemical 4 Stearyl Alcohol: KONOL series obtained by New Japan Chemical 5 Silicones: 85%/15% (weight base) mixture of D5 Cyclomethicone and dimethicone gum (weight average molecular weight of about 400,000 to about 600,000) obtained by General Electric Co.

6 Kathon CG: Mixture of methylchloroisothiazoline and methylisothiazoline obtained by Rohm & Haas Co.

Example III

The present residual obtained in a monolayer HDPE package was compared to a package with a HDPE outer layer and an inner layer of Dupont Elvax 3165 and a package with a DPE outer layer and an inner layer of Eastman 7673 PETG. The product used in the test was Olay Moisturizing Body Wash which contains: water, sodium laureth sulfate, soybean oil, sodium lauroamphoacetate, PEG-6 caprylic/capric glycerides, glycerin, cocamide MEA, palm kernel acid, maleated soybean oil, fragrances, citric acid, magnesium sulfate, sodium citrate, polyquaterium-10, sodium benzoate, DMDM hydantoin, and disodium EDTA. All three package types were identical in shape. Ten samples of each package type were tested.

The results of the test are below.

| Sample # | Initial Weight Bottle (g) | Initial Weight Bottle + Product (g) | Final Weight Bottle + Product (g) | Percent Residual |
|---|---|---|---|---|
| Monolayer HDPE Bottle | | | | |
| 1 | 25.75 | 255.85 | 43.54 | 7.7% |
| 2 | 26.03 | 258.96 | 45.16 | 8.2% |
| 3 | 26.15 | 256.03 | 43.59 | 7.6% |
| 4 | 25.86 | 256.08 | 44.50 | 8.1% |
| 5 | 26.24 | 259.61 | 41.56 | 6.6% |
| 6 | 26.29 | 257.08 | 44.56 | 7.9% |
| 7 | 26.29 | 257.78 | 48.92 | 9.8% |
| 8 | 25.84 | 256.40 | 42.42 | 7.2% |
| 9 | 25.72 | 257.29 | 45.92 | 8.7% |
| 10 | 25.89 | 255.97 | 43.27 | 7.6% |
| Average | | | | 7.9% |
| HDPE Outer Layer w/Elvax 3165 Inner Layer Bottle | | | | |
| 1 | 27.84 | 248.72 | 33.01 | 2.3% |
| 2 | 27.91 | 247.89 | 33.03 | 2.3% |
| 3 | 27.20 | 247.01 | 31.64 | 2.0% |
| 4 | 27.40 | 248.40 | 32.18 | 2.2% |
| 5 | 27.90 | 249.39 | 32.68 | 2.2% |
| 6 | 27.67 | 246.27 | 32.68 | 2.3% |
| 7 | 26.54 | 248.22 | 32.44 | 2.7% |
| 8 | 27.70 | 246.26 | 35.13 | 3.4% |
| 9 | 26.43 | 247.54 | 30.80 | 2.0% |
| 10 | 27.32 | 246.76 | 34.07 | 3.1% |
| Average | | | | 2.4% |
| HDPE Outer Layer w/6763 PETG Inner Layer Bottle | | | | |
| 1 | 26.76 | 255.08 | 31.70 | 2.2% |
| 2 | 26.85 | 258.02 | 31.67 | 2.1% |
| 3 | 29.02 | 260.60 | 34.70 | 2.5% |
| 4 | 28.78 | 258.01 | 34.44 | 2.5% |
| 5 | 26.79 | 258.66 | 32.68 | 2.5% |
| 6 | 26.96 | 258.82 | 31.57 | 2.0% |
| 7 | 28.67 | 259.68 | 33.68 | 2.2% |
| 8 | 28.29 | 258.70 | 33.54 | 2.3% |
| 9 | 26.87 | 256.63 | 32.32 | 2.4% |
| 10 | 28.58 | 259.49 | 34.23 | 2.4% |
| Average | | | | 2.3% |

As the data shows, the PETG inner layer and the Elvax 3165 inner layer significantly reduced the product residuals in the package as compared to the monolayer HDPE package.

While several particularly preferred embodiments of the present invention have been described and illustrated, it will now be obvious to those skilled in the art that various changes and modifications can be made thereto without departing from the spirit and scope of the invention. Accordingly, the following claims are intended to embrace such changes and modifications.

What is claimed is:

1. A product containment and delivery system for a comparatively viscous product, said containment and delivery system comprising in combination: (i) a comparatively high viscosity product having a viscosity of at least about 10,000 cps, said high viscosity product being a liquid or semi-liquid; and (ii) a flexible resiliently deformable, multi-layered plastic container having an inner polymer layer and an outer polymer layer, said inner polymer layer defining an inner surface of said container and said outer polymer layer defining a flexible outer surface of said container; characterized in that said inner layer comprises a material which is selected from the group consisting of polyesters, thermoplastic cellulosic, polycarbonates, polymethylmethacrylates, polyvinylchlorides, polyvinylidene chlorides, ethylene vinyl acetates with vinyl acetate content of at lest about 7.5%, ethylene vinyl alcohol copolymers, ionomer resins having at least 10% carboxylic acid groups neutralized by an alkali metal ion, and mixtures thereof, said inner polymer layer is bonded to said outer polymer layer, and said system has a residual level of less than 5% of said product.

2. The dispensing and delivery system according to claim 1, further characterized in that said inner polymer layer comprises thermoplastic cellulosic, and said thermoplastic cellulosic is cellulose acetate, cellulose acetate proprionate, or cellulose acetate butyrate.

3. The dispensing and delivery system according to claim 1, further characterized in that said product is selected from the group consisting of water-in-oil emulsions, oil-in-water emulsions, polymeric gels, foams, surfactant mixtures, dispersions, colloidal dispersions, suspensions, polymer solutions, polymer melts, or combinations thereof.

4. The dispensing and delivery system according to claim 1, further characterized in that said inner polymer layer comprises polyester, and said polyester is selected from the group consisting of polyethylene terephthalate, glycol-modified polyethylene terephthalate, and mixtures thereof.

5. The dispensing and delivery system according to claim 4, further characterized in that said multi-layered plastic container includes at least one additional layer between said inner polymer layer and said outer polymer layer.

6. The dispensing and delivery system according to claim 5, further characterized in that said multi-layered plastic container includes an adhesive layer.

7. The dispensing and delivery system according to claim 6, further characterized in that said multi-layered plastic container includes a regrind layer.

8. The dispensing and delivery system according to claim 6, further characterized in that said inner polymer layer exhibits a surface roughness of less than 5 $\mu$m.

9. The dispensing and delivery system according to claim 8, further characterized in that said outer polymer layer is selected from the group consisting of polyethylene, polypropylene, polyvinyl chloride, polystyrene, and mixtures thereof.

10. The dispensing and delivery system according to claim 8, further characterized in that said inner polymer layer exhibits a surface roughness of less than 3 $\mu$m.

11. The dispensing and delivery system according to claim 10, further characterized in that said inner polymer layer exhibits a surface roughness of less than 2 $\mu$m.

* * * * *